United States Patent [19]

Kropp et al.

[11] Patent Number: 4,913,057

[45] Date of Patent: Apr. 3, 1990

[54] ARMOR PIERCING SHELL

[75] Inventors: Hans-Erik Kropp; Hans Gustafsson; Kenneth Andersson, all of Karlskoga, Sweden

[73] Assignee: Aktiebolaget Bofors, Bofors, Sweden

[21] Appl. No.: 401,543

[22] Filed: Aug. 31, 1989

Related U.S. Application Data

[63] Continuation of Ser. No. 177,431, Apr. 4, 1988, abandoned.

[30] Foreign Application Priority Data

Apr. 3, 1987 [SE] Sweden ..... 8701397

[51] Int. Cl.[4] ..... F42B 13/10

[52] U.S. Cl. ..... 102/476; 102/216; 102/272; 102/499

[58] Field of Search ..... 102/476, 499, 517, 519, 102/216, 272

[56] References Cited

U.S. PATENT DOCUMENTS

| | | | |
|---|---|---|---|
| 3,373,687 | 3/1968 | Simmons | 102/476 |
| 3,715,985 | 2/1973 | Fugelso | 102/216 |
| 4,463,678 | 8/1984 | Weimer et al. | 102/476 |

FOREIGN PATENT DOCUMENTS

| | | | |
|---|---|---|---|
| 166074 | 1/1986 | European Pat. Off. | 102/216 |
| 196283 | 10/1986 | European Pat. Off. | 102/476 |
| 1292321 | 3/1962 | France | 102/216 |
| 2311271 | 5/1971 | France | 102/476 |

*Primary Examiner*—Harold J. Tudor
*Attorney, Agent, or Firm*—Pollock, Vande Sande & Priddy

[57] ABSTRACT

In an armor piercing explosive shell of the kind which comprises a hollow charge and an impact contact member placed in the nose cone of the shell to provide electrical contact for initiation of the hollow charge upon impact of the shell against the target, the nose cone of the shell is provided with a reinforced tip for mechanical penetration of the active armor and the impact contact member does not extend all the way to the tip but positioned behind an inner shoulder made in the wall of the nose cone to improve the penetrative performance of the shell against targets protected by active armor.

3 Claims, 2 Drawing Sheets

ARMOR PIERCING SHELL

This application is a continuation, of Ser. No. 177,431, filed on Monday, Apr. 4, 1988, now abandoned.

BACKGROUND OF THE INVENTION

The present invention relates to an armor piercing shell of the kind comprising a nose cone with a reinforced tip for mechanical penetration of active armor and an impact contact member placed in the nose cone of the shell arranged to provide initiation of the charge upon impact of the shell against a target.

For combating armoured vehicles, particularly tanks, it is previously known to use different types of antitank ammunition. Such ammunition is designed to penetrate even thick armor plates. Armor piercing shells are a special type of anti-tank ammunition which is provided with a hollow charge warhead. In principle, a hollow charge warhead comprises an outer casing, a metal cone and an explosive. when the explosive detonates, the metal cone is squeezed together and a metal jet is formed which, with great force, penetrates even very thick and hard armor. By virtue of its good effect in armored targets, the hollow charges have long constituted a serious threat to armoured vehicles.

Due to the development that has taken place on the protection side through the introduction of composite armor, active armor, etc, the importance of improving the penetrability of the warhead has, however, increased.

Armored targets can be equipped with active armor in the form of separate mountings placed in front of and at a distance from the main armor of the target. Such active armor may typically comprise two steel plates with an intermediate layer of pentyl explosive paste. Normally, active armor of this kind will disturb the hollow charge jet of the shell, its penetrative ability being drastically reduced due to the fact that the jet is broken up into fragments which tumble and are dispersed.

An armor piercing shell with provided penetrative ability against active armor is previously known by EP No. 0 196 283. In this case the improved penetrative ability has been accomplished by means of a specific design of the nose cone of the shell so that it is able to mechanically pentrate the active armor before the hollow charge is initiated. This means that the penetration jet of the hollow charge can pass undisturbed by the active armor so that full penetrability is obtained in the main target. Specifically, the nose cone has a reinforced tip for mechanical penetration of the active armor and the impact contact member is so positioned in the nose cone that contact is obtained only when the reinforced tip has penetrated aside the active armour without detonation.

In this European patent publication a preferred embodiment is illustrated in which the tip of the nose cone is solid and sharper than in conventional anti-tank shells and the impact contact member is not extended all the way to the tip of the shell. By this means, the delay is accomplished which is required in order for the shell to have time to penetrate the active armour before the hollow charge is initiated.

Armor piercing shells of the above-mentioned type have a very good effect at typical angles of impact, that is angles within the range of 20°–60°. At very small angles of impact, such as 20°–30°, there is a tendency, however, that the shell case is twisted at the impact with a deteriorated contact function as a consequence.

Also on impacts perpendicular to the armor there is a tendency to a deteriorated contact function for the above-mentioned armor piercing shell which might depend on a certain bending of the walls of the nose cone on impact with an undesired delay of the contact function as a result.

SUMMARY OF THE INVENTION

The object of the present invention is therefore to provide an armor piercing shell for which an increased penetrative ability against active armor is maintained at small angles of impact as well as at an impact of right angle.

A main characterizing feature of the invention is that the front part of the nose cone has an inner shoulder so that the nose cone wall is changed through the shoulder to a front part with increased wall thickness and that the front part of the impact contact member is positioned behind the shoulder.

In a preferred embodiment of the invention the shoulder comprises an annular surface in a plane perpendicular to the longitudinal axis of the shell. Upon impact of the shell at right angle against a target the front part of the contact member hits the shoulder and the ignition system of the shell is closed and the hollow charge warhead is initiated.

BRIEF DESCRIPTION OF THE DRAWINGS

In the following the invention will be described more in detail in connection with the accompanying drawings in which.

DETAILED DESCRIPTION OF THE PREFERRED EMBODIMENT(S).

Figure 1:
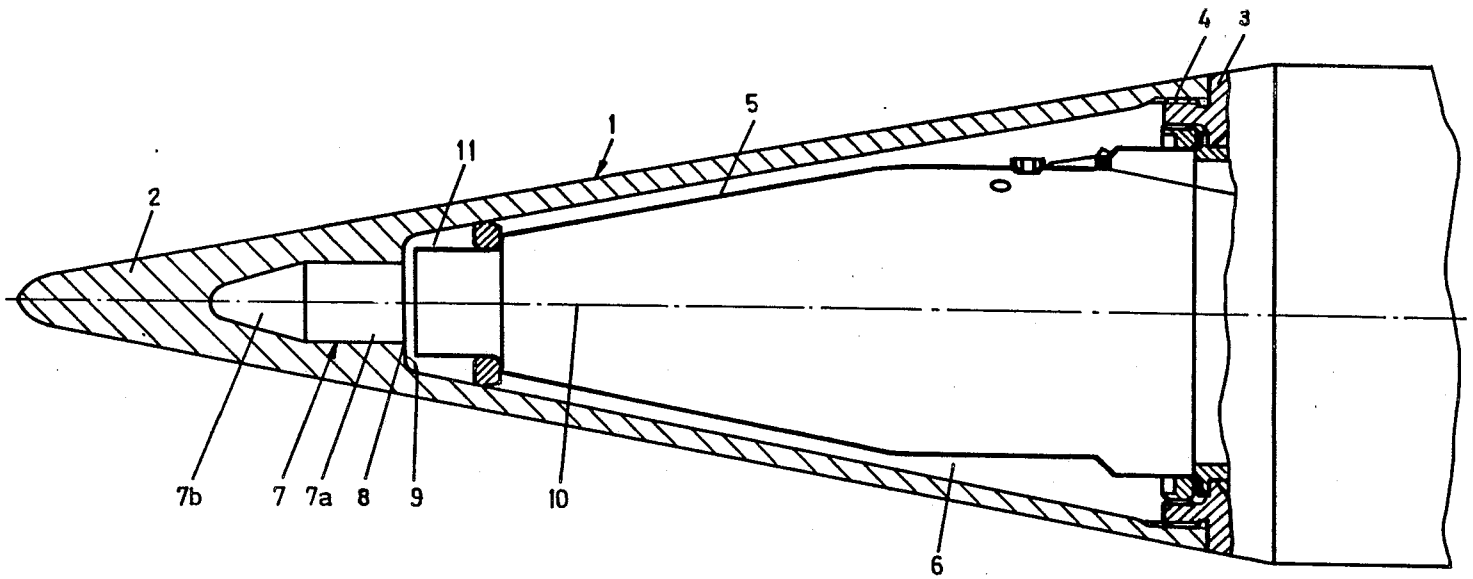
FIG. 1 illustrates a first embodiment of the present invention shell having a solid, sharp tip and FIG. 2 a second embodiment of the present invention shell with a solid, cut-off tip.

FIG. 1 shows the front part of an armor piercing explosive shell comprising a nose cone 1 with a reinforced tip 2. The nose cone is screwed onto the shell body by means of a thread 4. The nose cone could also comprise two parts, a rear part which is screwed onto the body of the shell and a front cap.

Like the previously known armor piercing explosive shell according to EP No. 196 283 the reinforced tip is optimated to be able to penetrate aside the active armour without this detonating. As already mentioned the tip is solid and has a decidedly small tip radius and the material thickness of the tip in the longitudinal direction is thus at least 4–5 times the wall thickness of the rear part of the nose cone. The nose cone wall is also made of a harder material than for a conventional shell. If the nose cone is divided then at least the front part (cap) is made of a harder material.

Figure 2:
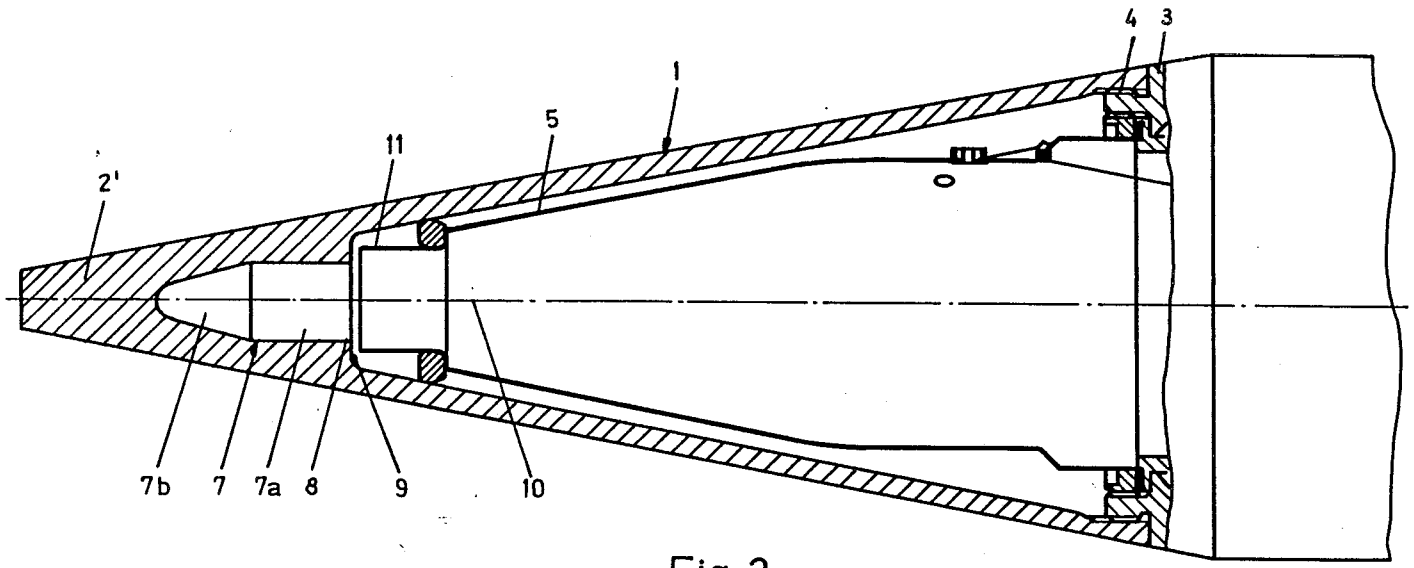

The tip 2' of the shell illustrated in FIG. 2 is also solid but cut-off in contrast to the sharp tip illustrated in figure 1. Such a cut-off tip could in some applications increase the penetrative ability as the risk for bending of the tip against an inclined target surface is less for this type of tip. Otherwise there is no difference between the two nose cones.

Like the previously known armor piercing explosive shell the nose cone also comprises an impact contact member in the form of a full-calibre double sheath, an outer sheath incorporated in the outer casing of the shell and an inner sheath 5. The outer and inner sheaths are disposed in an unused shell at a distance from and isolated from each other so as upon impact of the shell against the target to be able to enter into coaction and make electrical contact with each other. The sheats form a passive end contact in the ignition system of the shell for initiation of the hollow charge. The nose cone comprises a rear, larger spacing 6 in which the impact contact member is disposed and a front, smaller spacing 7 with increased wall thickness. The change in wall thickness, i e the change from the comparatively thin walls of the rear spacing 6 of the nose cone and the thicker walls of the front spacing 7, is formed as an inner shoulder 8 having an annular surface 9 in a plane perpendicular to the longitudinal axis 10 of the shell. The cylindrical front part 11 of the impact contact member is located just behind the shoulder 8 and isolated therefrom, but so arranged that it upon impact against a target is able to enter into coaction with the annular surface of the shoulder and make electrical contact with the outer casing.

The front spacing 7 comprises a rear cylindrical part *7a* and a front conical part *7b*. The length of the spacing 7 is within 10–20% of the length of the spacing 6. The increased wall thickness of the front spacing 7 of the nose cone improves the penetrative ability of the shell for very small angles of impact thanks to the increased torsional strength as well as for impacts at a right angle so that the risk for a bending and a corresponding misfunction of the impact contact member is reduced.

I claim:

1. An armor-piercing explosive shell comprising in combination:

a rear portion containing a hollow charge;

a front portion connected to said rear portion and comprising a substantially cone-shaped outer casing defining an interior cavity, said outer casing including a forwardmost part and a rearward part, said forwardmost part having a wall with a thickness which is substantially greater than the thickness of the wall of said rearward portion, said forwardmost part providing a reinforced tip for mechanical penetration of active armor;

said outer casing including an inwardly-projecting annular shoulder formed in said wall between said forwardmost part and said rearward part;

said interior cavity rearwardly of said annular shoulder containing an electrical contact member which is of generally frusto-conical shape over at least a portion of its length and has an outer surface closely spaced from said casing and a front part positioned just rearwardly of said annular shoulder which provides an electrical contact surface for said front part of said electrical contact member; and means effective only when said outer casing is deformed to a sufficient extend rearwardly of its forwardmost end by its impingement upon a target to result in electrical contact being made between said outer casing and said electrical contact member through said annular shoulder to detonate said hollow charge.

2. An armor piercing explosive shell according to claim 1, wherein said shoulder comprises an annular surface in a plane perpendicular to the longitudinal axis of the shell.

3. An armor piercing explosive shell according to claim 2, wherein said interior cavity at said forwardmost portion of said outer casing forwardly of said annular shoulder includes a cylindrically-shaped part and a conically-shaped part.

* * * * *